US006389257B1

(12) United States Patent
Harumoto et al.

(10) Patent No.: US 6,389,257 B1
(45) Date of Patent: May 14, 2002

(54) DEVELOPER CARTRIDGE HAVING A SPIRALLY-FORMED FEEDING MEMBER MOUNTED IN A CYLINDRICAL MEMBER AND METHOD OF MANUFACTURING THE SAME

(75) Inventors: Katsumi Harumoto; Toshio Masubuchi, both of Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/663,411

(22) Filed: Sep. 15, 2000

(30) Foreign Application Priority Data

Dec. 24, 1999 (JP) ..... 11-367639

(51) Int. Cl.[7] ..... G03G 15/08
(52) U.S. Cl. ..... 399/262; 399/263
(58) Field of Search ..... 399/109, 262, 399/263

(56) References Cited

U.S. PATENT DOCUMENTS 6,088,561 A * 7/2000 Kawamura et al. ..... 399/262

FOREIGN PATENT DOCUMENTS

JP 11-160987 6/1999

* cited by examiner

*Primary Examiner*—William J. Royer
(74) *Attorney, Agent, or Firm*—Morgan, Lewis & Bockius LLP

(57) ABSTRACT

A developer cartridge includes a cylindrical member in which developer containing at least toner is stocked, a supply port opened in the cylindrical member, and a spiral feeding member which is freely rotatably disposed in the cylindrical member and rotated to feed the developer stocked in the cylindrical member to the supply port. The feeding member is mounted in the cylindrical member after developer is filled in the cylindrical member.

18 Claims, 13 Drawing Sheets

INSERTION CHECK RESULT OF TIP SHAFT OF AGITATOR

| | Ⓐ ANGLE(DEGREE) | | | | | | | |
|---|---|---|---|---|---|---|---|---|
| | 30 | 45 | 60 | 75 | 90 | 105 | 120 | 135 |
| INSERTION PERFORMANCE OF TIP OF AGITATOR | ○ | ○ | ○ | ○ | △ | × | × | × |
| NG FREQUENCY | 0/10 | 0/10 | 0/10 | 0/10 | 4/10 | 10/10 | 10/10 | 10/10 |

DEVELOPER CARTRIDGE HAVING A SPIRALLY-FORMED FEEDING MEMBER MOUNTED IN A CYLINDRICAL MEMBER AND METHOD OF MANUFACTURING THE SAME

BACKGROUND OF THE INVENTION

1. Field of the Invention

The present invention relates to a developing cartridge used in an image forming apparatus such as a printer apparatus, a copying machine, a facsimile machine or the like to which an electrophotographic system is applied, and more particularly to a developer cartridge having a spirally-formed feeding member mounted in a cylindrical member.

2. Description of the Related Art

In a conventional image forming apparatus, such as a full color printer apparatus or the like, to which an electrophotographic system is applied, normally three developers for developing electrostatic latent images with three primary color developers of Y (yellow), M (magenta) and C (cyan), preferably four developers containing the above three developers and a black color developer for developing an electrostatic latent image with black (K) developer are mounted so that one of these plural color developers is selectively disposed in the neighborhood of an electrostatic latent image carrier or each of these plural developers is disposed in the neighborhood of each of plural electrostatic latent image carriers corresponding to the respective color developers, and an electrostatic latent image formed on the single electrostatic latent image carrier or electrostatic latent images formed on the plural electrostatic latent image carrier are successively visualized by the corresponding color developers, thereby forming a full color image.

When attributing importance to the compact size of the apparatus or reduction of the cost of the apparatus in the above full color image forming apparatus, though an image forming speed slows down a little, the method of selectively disposing one of the plural developers in the neighborhood of the single electrostatic latent image carrier is adopted. The inventors of this application have tackled to implement such an image forming apparatus that a rotator having four developers disposed along the peripheral direction thereof is rotatably disposed, and when an electrostatic latent image formed on an electrostatic latent image carrier is developed by each developer, the rotator is rotated so that a desired color developer is disposed so as to confront the electrostatic latent image carrier.

In a full color image forming apparatus being considered by the inventors, a system using a toner cartridge is adopted to supplement toner to each developer. The toner cartridge is detachably mounted in the developer, and it is designed so that an operator of the image forming apparatus replaces a toner cartridge with a new one when all the toner in the toner cartridge concerned is consumed.

As the toner cartridge as described above is proposed a toner cartridge using a so-called "trickle developing system" which is called by the inventors of this application and in which developer containing at least toner is supplied from the toner cartridge concerned to the developer and deteriorated developer is withdrawn from the developer into the toner cartridge little by little. This type toner cartridge using the trickle developing system has been introduced into actual machines.

In the toner cartridge using the "trickle developing system", a withdrawing unit for stocking old developer thus withdrawn is disposed at the end portion of the toner cartridge concerned. This toner cartridge is generally designed so that a rotational fixing portion of an agitator for supplying new developer is provided at a toner cap side in order to minimize the volume of the withdrawing portion for the old developer and increase the volume of the stock portion for the new developer.

However, the above conventional technique has the following problems. That is, in the case of the conventional toner cartridge as described above, the rotational fixing portion of the agitator for supplying new developer is provided at the toner cap side, and thus after developer containing at least toner is filled into the toner cartridge, the agitator which has been mounted in the toner cartridge must be fitted to the driving portion of the toner cap at the same time when the toner cap is mounted into the main body of the toner cartridge, so that it is very difficult to perform a toner cap mount work.

Furthermore, in the case of the above conventional toner cartridge, when toner is filled into the toner cartridge in such a state that the agitator is disposed in the toner cartridge, air is contaminated into toner to reduce the apparent density of the toner and thus reduce the substantial toner fill amount per unit time, so that the working efficiency of filling the toner into the toner cartridge is reduced.

Still furthermore, in the case of the above conventional toner cartridge, a so-called one-side supported type toner cartridge in which an agitator for feeding toner is supported only at the toner cap side is used. In this case, in connection with recent requirements of enhancing image quality and designing the apparatus in compact size, the toner particle size is reduced and toner containing wax which enables elimination of oil as separating agent in the fixer is used. In this case, there may occur such a problem that the toner particles aggregate together to form lumps of toner due to the slight rubbing between the agitator and the inner wall of the toner cartridge, and these lumps of toner are developed to induce degradation of image quality.

In addition, in the case of a toner cartridge using a so-called one-side supported type agitator, the rotational torque for rotating the agitator is increased due to the rubbing between the agitator and the inner wall of the toner cartridge, the eccentric rotation of the agitator or the like, so that a driving device for rotating the agitator must be designed in large size.

Therefore, in order to solve the above problems, it may be considered that a so-called double-side supported type agitator in which both the end portions of an agitator are supported is used in place of the so-called one-side supported type agitator.

However, even when the double-side supported type agitator is used, there is still such a problem that the center portion of the agitator may interfere in the inner wall of the toner cartridge due to warp caused by the agitator's own weight, warp caused by the press force of the toner particles, or warp caused by centrifugal force occurring during rotation or at acceleration occurring at the stop time of the rotation in the case of a rotational type developing apparatus.

Furthermore, in order to enhance the fill efficiency of the toner, it is necessary to mount an agitator in a toner cartridge after toner is filled in the toner cartridge. However, in this case, it is required that the agitator is mounted in the toner cartridge after the toner is filled in the toner cartridge, and also the tip portion of the agitator is fitted into the bearing portion. According, there is such a problem that the tip portion of the agitator may not be surely fitted into the bearing portion due to a failure of fitting, and thus a defective toner cartridge is liable to be produced.

In addition, when the agitator is mounted after the toner is filled in the toner cartridge, there occurs such a new problem that the toner is trapped at the bearing portion in the toner cartridge and thus the agitator cannot be inserted into the bearing portion.

Furthermore, in order to avoid the trap of the toner at the bearing portion, it is considered that a toner escaping hole is provided to the bearing portion. However, if the position of the toner escaping hole is improper, the toner rather invades into the bearing portion, and lumps of toner are formed in the bearing portion by rotation of the agitator shaft. The lumps of toner thus formed in the bearing portion leak from the escaping hole, and induce defects in image quality.

Still furthermore, in the case of the so-called double-side supported type agitator, when the agitator is mounted after the toner is filled in the toner cartridge, there occurs such a new problem that it cannot be judged by a visual check or the like whether the shaft portion of the agitator is normally fitted into the bearing portion in the toner cartridge.

SUMMARY OF THE INVENTION

In view of the above circumstances, the present invention aims to provide a developer cartridge in which developer containing at least toner can be efficiently filled.

The present invention also aims to provide a developer cartridge which enables a mount work of a cap member to be easily performed even when the developer cartridge is designed so that a feeding member is mounted in the developer cartridge after developer containing at least toner is filled in the developer cartridge.

The present invention also aims to provide a developer cartridge which can surely prevent a feeding member and the inner wall of a developer cartridge from being rubbed against each other even when the particle diameter of toner is reduced or toner containing wax is used, thereby preventing the image quality from being degraded due to agglomerated toner.

The present invention also aims to provide a developer cartridge which can avoid a driving device for rotating a feeding member from being designed in large size.

The present invention also aims to provide a developer cartridge which can surely prevent the interference between a feeding member and the inner wall of the developer cartridge even when the feeding member is designed as a so-called double-side supported type.

The present invention also aims to provide a developer cartridge which can surely pivotally support the tip of the feeding member even when the feeding member is designed as a so-called double-side supported type.

The present invention also aims to provide a developer cartridge which can surely prevent toner particles from being newly agglomerated at the bearing portion of the feeding member even when the feeding member is designed as a so-called double-side supported type.

The present invention also aims to provide a developer cartridge which can easily check whether a feeding member is normally pivotally supported even when the feeding member is designed as a so-called double-side supported type.

That is, according to a first aspect of the present invention, there is provided a developer cartridge having a cylindrical member in which developer containing at least toner is stocked, a supply port opened in one end side of the cylindrical member and a spiral feeding member which is freely rotatably disposed in the cylindrical member, the feeding member being rotated to feed the developer stocked in the cylindrical member to the support port, characterized in that the feeding member is mounted in the cylindrical member after developer is filled in the cylindrical member.

According to a second aspect of the present invention, in the developer cartridge of the first aspect, one end portion of the feeding member is freely rotatably attached to a cap member for sealing the open end portion of the cylindrical member through which the developer is filled, and the feeding member is mounted in the cylindrical member while being attached to the cap member.

According to a third aspect of the present invention, in the developer cartridge of the first aspect, when the feeding member is mounted in the cylindrical member, the feeding member is inserted into the cylindrical member filled with the developer while being rotated.

According to a fourth aspect of the present invention, in the developer cartridge of the third aspect, the rotational direction of the feeding member is the same direction as the winding direction of the spiral of the feeding member.

According to a fifth aspect of the present invention, in the developer cartridge of the first aspect, the end portion of the feeding member located at the opposite side to the cap member is pivotally supported in the cylindrical member through a shaft member and a bearing member.

According to a sixth aspect of the present invention, in the developer cartridge of the fifth aspect, the tip portion of the shaft member fixed to the end portion of the feeding member is designed in a tapered shape, and the tip portion of the shaft member is designed to have an acute angle less than 90 degrees.

According to a seventh aspect of the present invention, in the developer cartridge of the fifth or sixth aspect, a developer discharging portion for discharging developer trapped in the bearing member when the shaft member is fitted into the bearing member is provided at the tip portion of the shaft member.

According to an eighth aspect of the present invention, in the developer cartridge of the fifth or sixth aspect of the present invention, a guide portion for guiding the shaft member into the bearing member is provided to the tip portion of the bearing member.

According to a ninth aspect of the present invention, in the developer cartridge of the fifth or sixth aspect of the present invention, a developer discharging portion for discharging developer trapped in the bearing member is provided to the bearing member when the shaft member is fitted into the bearing member.

According to a tenth aspect of the present invention, in the developer cartridge of the ninth aspect of the present invention, the developer discharging portion provided to the bearing member comprises plural opening portions formed along the axial direction on the inner surface of the bearing member.

According to an eleventh aspect of the present invention, in the developer cartridge of the tenth aspect of the present invention, the opening portions are not opened in the radial direction of the bearing member.

According to a twelfth aspect of the present invention, in the developer cartridge of the fifth aspect of the present invention, the feeding member is supported at both the end portions by a shaft, and is not brought into contact with the inner wall of the cylindrical member even when it is most warped.

According to a thirteenth aspect of the present invention, in the developer cartridge of the twelfth aspect of the present invention, the center portion of the feeding member in the axial direction is set to be smaller in diameter than both the end portions thereof.

According to a fourteenth aspect of the present invention, in the developer cartridge of the twelfth aspect of the present invention, the feeding member comprises a linear portion extending in the axial direction of the cylindrical member and a spiral portion which is provided spirally around the outer periphery of the linear portion, and the spiral portion is fixed to the linear portion at the center portion of the feeding member to prevent the spiral portion from being deformed.

According to a fifteenth aspect of the present invention, in the developer cartridge of the fifth aspect of the present invention, a shaft member is fixed to the tip of the feeding member, and the fixing force of the shaft member is set to such a level that the shaft member does not fall off the feeding member even when the shaft member is not fitted into the bearing member at the cylindrical member side and the feeding member is deformed.

According to a sixteenth aspect of the present invention, in the developer cartridge of the fifth aspect of the present invention, a shaft member is fixed to the tip of the feeding member, and there is provided a rotation stopping member for stopping the rotation of the feeding member when the shaft member is not fitted into the bearing member at the cylindrical member side.

According to a seventeenth aspect of the present invention, in the developer cartridge of the sixteenth aspect of the present invention, the bearing member is fixed to the tip of the feeding member and a through hole is formed inside the bearing member.

BRIEF DESCRIPTION OF THE DRAWINGS

A preferred embodiment of the present invention will be described in detail based on the following figures, wherein:

FIGS. 1A and 1B show a developer cartridge according to a first embodiment of the present invention, wherein FIG. 1B is a side view of the developer cartridge and FIG. 1A is a longitudinal-sectional view taken along A—A line of FIG. 1B;

DETAILED DESCRIPTION OF THE PREFERRED EMBODIMENT

A preferred embodiment according to the present invention will be described hereunder with reference to the accompanying drawings.

[First Embodiment]

Figure 2:
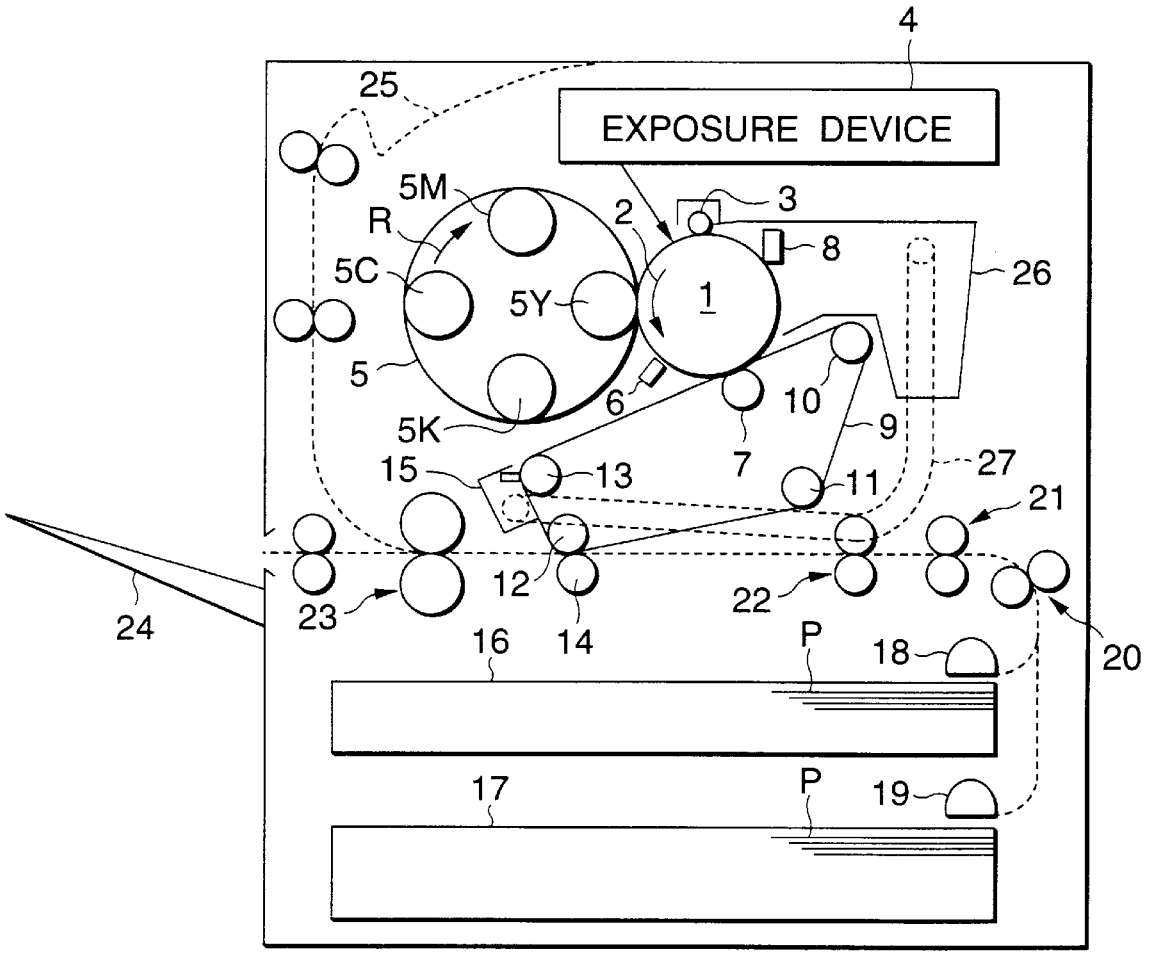
FIG. 2 is a diagram showing a full color printer apparatus to which the developer cartridge of the first embodiment is applied.

FIG. 2 shows a full color printer apparatus as an image forming apparatus to which a developer cartridge according to a first embodiment of the present invention is applied.

In FIG. 2, reference numeral 1 represents a photosensitive drum as an image carrier, and the photosensitive drum 1 is rotated at a predetermined speed along the direction indicated by an arrow 2 by a driving unit (not shown). The surface of the photosensitive drum is uniformly charged so as to be kept to a predetermined potential by a charging roll 3, and then four color images of yellow (Y), magenta (M), cyan (C) and black (K) are successively exposed to light by an exposure device 4 formed of ROS (Raster Output Scanner) or the like to form electrostatic latent images corresponding to the respective colors if a full color image is formed. The predetermined color electrostatic latent images formed on the surface of the photosensitive drum 1 are respectively developed by corresponding developers 5Y, 5M, 5C, 5K of a rotary type developing apparatus 5 to form predetermined color toner images.

The rotary type developing apparatus 5 has the four color developers 5Y, 5M, 5C, 5K of yellow (Y), magenta (M), cyan (C), black (Y) to perform a full color developing operation, and the respective developers 5Y, 5M, 5C, 5K develop the latent images on the photosensitive drum 1 with yellow, magenta, cyan and black toner materials. When each color toner image is developed, the rotary type developing apparatus 5 is rotated in the direction indicated by an arrow R by a motor (not shown), and the corresponding one of the developers 5Y, 5M, 5C and 5K is located at a developing position at which the developer concerned confronts the photosensitive drum 1. In a process control mode, a test chart is formed on the photosensitive drum 1, and the density of the test chart is detected by a sensor 6. Each color toner image developed on the photosensitive drum 1 is successively transferred onto an intermediate transfer belt 9 as an intermediate transfer medium by a primary transfer roll 7, and finally four color toner images are transferred onto the intermediate transfer belt 9 while being superposed on one another.

The intermediate transfer belt 9 is rotatably suspended under tension by a driving roll 10, an idle roll 11, a backup roll 12 and an idle roll 13. The driving roll 10 is driven by a driving motor having an excellent constant-speed driving performance (not shown), and it serves to rotate the intermediate transfer belt 9 at a predetermined speed.

The four color toner images which are superimposed on the intermediate transfer belt 9 are collectively transferred onto a recording sheet P as a recording medium by a secondary transfer roll 14 which is pressed against the recording sheet P through the backup roll 12 and the intermediate transfer belt 9. The recording sheet P is supplied from any one of two sheet supply cassettes 16, 17 provided at the lower portion of the printer apparatus by a sheet supply roll 18 or 19, fed through plural feeding roll pairs 20, 21 to a registration roll pair 22 and then temporarily stopped there. Thereafter, the registration roll pair 22 which starts its rotation in synchronism with the toner image transferred onto the intermediate transfer belt 9 feeds the recording sheet P to a secondary transfer position at which the backup roll 12 and the secondary transfer roll 14 are pressed against each other through the intermediate transfer belt 9. After the four color toner images are collectively transferred from the surface of the intermediate transfer belt 9 onto the recording sheet at the secondary transfer position, the recording sheet P is subjected to a fixing treatment using heat and pressure in a fixer 23, and discharged to a discharge tray 24 at the side surface of the main body of the apparatus or a discharge tray 25 at the upper portion of the main body of the apparatus by a switching operation of a switching gate (not shown).

After the toner image transfer step is completed, residual toner is removed from the photosensitive drum 1 by a cleaning device 8 formed of a blade or the like, and the photosensitive drum 1 is on standby for a next image forming step or the like. Further, after the toner image transfer step is completed, residual toner is removed from the intermediate transfer belt 9 by a belt cleaner 15 located so as to confront the idle roll 13, and the intermediate transfer belt 9 is on standby for a next image forming step.

The wasted toner scraped off the photosensitive drum 1 or the intermediate transfer belt 9 by the cleaning device 8 and the belt cleaner 15 is withdrawn into a waste toner withdrawing tank 26. Particularly, the waste toner withdrawn from the belt cleaner 15 is fed to the waste toner withdrawing tank 26 through a transport pipe 27 by a feeding unit constructed by an auger, a feeding screw, etc.

Figure 3:
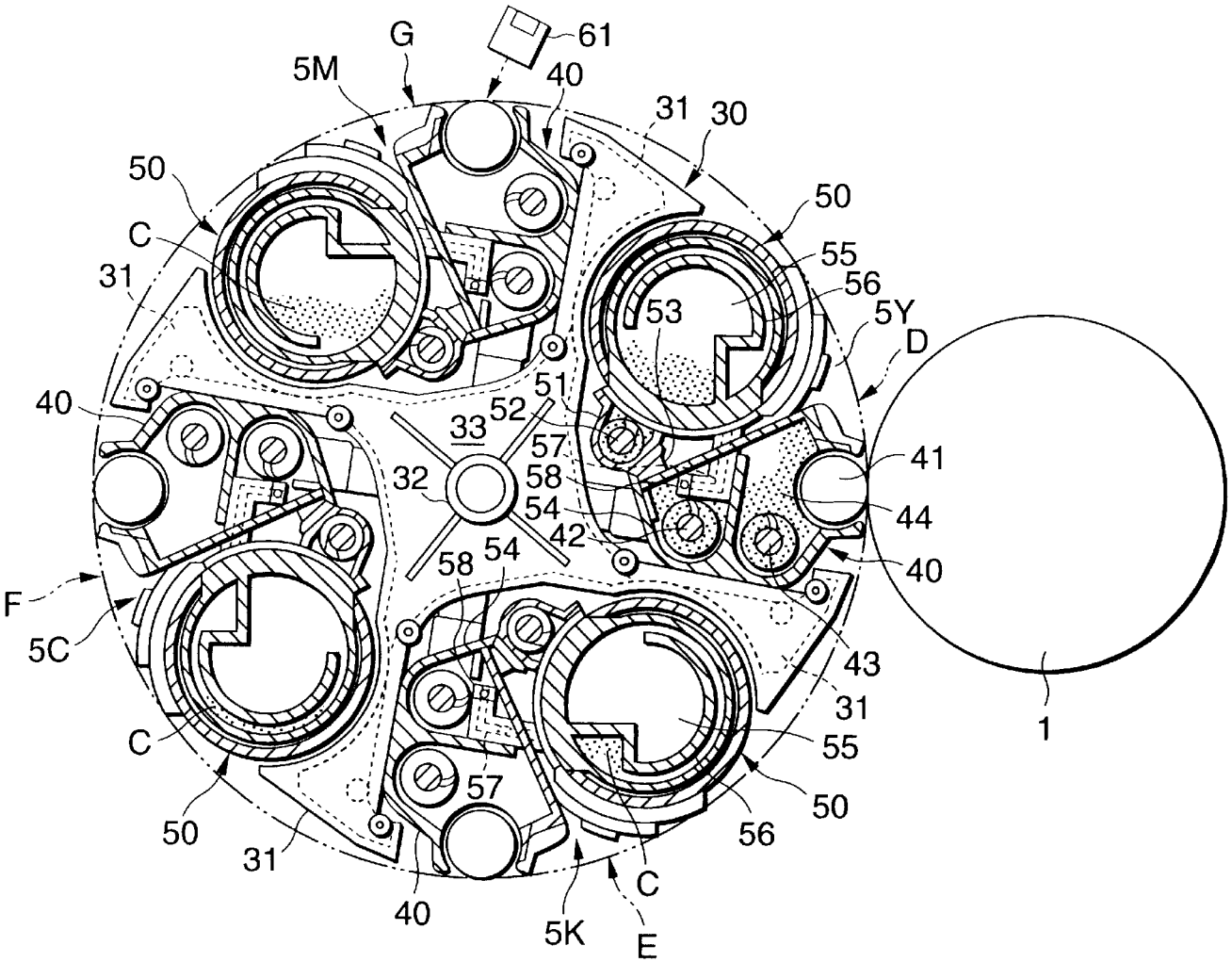
FIG. 3 is a diagram showing the construction of a rotary type developing apparatus to which the developer cartridge of the first embodiment is applied.

FIG. 3 is a cross-sectional view showing an embodiment of the rotary type developing apparatus 5.

As shown in FIG. 3, the rotary type developing apparatus 5 has a rotor 30 which rotates in a clockwise direction around a rotational shaft 32 located at the center thereof. The rotor 30 has a center portion 33 designed in a substantially square form, and four arms 31 which extend substantially in the radial direction from the center portion 33 so as to intersect to one another at 90 degrees. The four developers 5Y, 5M, 5C, 5K of yellow (Y), magenta (M), cyan (C), black (K) are mounted to the arms 31 of the rotor 30 by a mounting unit (not shown).

All the developers 5Y, 5M, 5C, 5K are constructed in the same structure, and the developer 5Y of yellow (Y) will be representatively described. The developer 5Y of yellow (Y) is mainly divided into a developer main body 40 and a developer cartridge 50.

In the developer main body 40 are provided an elongated developing roll 41 extending in the vertical direction to the surface of the drawing, and two spiral augers 42, 43 which are located at the back surface side of the developing roll 41 and extend in parallel to the developing roll 41. Here, when the developing roll 41 is rotated, the spiral auger 42 feeds developer 44 stocked in the developer main body 40 while stirring the developer 44 in one direction perpendicular to the surface of the drawing. On the other hand, the other spiral auger 43 feeds the developer 44 while stirring the developer 44 in the opposite direction to the feeding direction of the spiral auger 42, and uniformly supplies the developer 44 to the developing roll 41.

The developing roll 41 magnetically absorbs carriers contained in the developer 44 by a magnet roll (not shown) disposed therein, forms a magnetic brush of developer 44 on the surface thereof and feeds the toner absorbed to the carriers to a developing area confronting the photosensitive drum 1. The electrostatic latent image formed on the photosensitive drum 1 is visualized by the magnetic brush of the developer 44 which is formed of the carriers and the toner on the surface of the developing roll 41.

The developing cartridge 50 is formed of an elongated cylindrical container extending in the vertical direction to the surface of the drawing, and the inside of the developer cartridge 50 is divided into a stock chamber for new developer and a withdrawing chamber for deteriorated developer. The stock chamber for the new developer is provided with a supply port (not shown), and the supply port intercommunicates with a substantially cylindrical casing 51 for guiding the new developer to the developer main body 40. The cylindrical casing 51 is provided at the upper portion of the back surface side of the developer main body 40. A spiral auger 52 is disposed in the casing 51, and the developer 44 supplemented from the developer cartridge 50 is guided by the spiral auger 52 to the supply port 53 provided on the upper surface of the back surface side of the developer main body 40 and supplemented into the developer main body 40. A flap 54 is provided at the outlet port located at the lower end portion of the supply port 53 of the developer main body 40 so as to be freely opened/closed, and it is opened when the developer 5Y is located at a developing position D of FIG. 3. On the other hand, the flap 54 is closed by its own weight when the developer 5Y is located at a position F or position G of FIG. 3.

A circulating withdrawing passage 56 is provided to the deteriorated developer withdrawing chamber 55 of the developer cartridge 50, and a discharge pipe 57 which is bent in a substantially L-shaped form is connected to the withdrawing passage 56. The discharge pipe 57 is disposed at the upper portion of the substantially center portion of the developer main body 40, and a withdrawing port 58 located at the tip (lower end in FIG. 3) of the discharge pipe 57 is located in the developer main body 40. The withdrawing port 58 is located at the front side of the supply port 53 for the new developer, and also it is opened to the ceiling wall portion of the developer main body 40. The new developer 44 supplied from the supply port 53 is stirred/fed by the spiral augers 42, 43, and it is supplied to the developing roll 41 while it is circulated in the developer main body 40, thereby contributing to the development. The old developer 44 contributing to the developing step while circulating in the developer main body 40 is withdrawn through the withdrawing passage 56 into the deteriorated developer withdrawing chamber 55 of the developer cartridge 50 by the withdrawing port 58 when the developer main body 40 is located at a position E or F in FIG. 3.

In the rotary type developing apparatus 5 having the developers 5M, 5C, 5K which are designed in the same construction as the developer 5Y thus constructed, when the developer main body 40 arrives at the developing position (D position) confronting the photosensitive drum 1, the flap 54 opens the supply port 53 by its own weight, and the new developer 44 is supplemented into the developer main body 40 by rotating the spiral auger 52 if necessary. When the development of the electrostatic latent image on the photosensitive drum 1 is completed by the developer main body 40, the rotor 30 is clockwise rotated and the developer is shifted from the D position to the lower and right E position, the flap 54 is semi-opened as shown in the drawing, the withdrawing port 58 is placed face up, the old developer fed through the discharge pipe 57 flows to the withdrawing passage 56 without flowing backward into the developer main body 40. This deteriorated developer C is passed through the withdrawing passage 56 and withdrawn to the deteriorated developer withdrawing chamber 55 until the developer main body 40 is shifted from the lower and left F position to the upper and left G position. As described above, by providing the circulating withdrawing passage 56, the developer C to be withdrawn can be prevented from flowing backward into the developer main body 40.

Further, during the shift of the developer main body 40 from the upper and left G position to the upper and right D position (developing position), the new developer 44 is fed to the casing 51 by an action of an agitator (not shown) provided in the developer cartridge 50, and guided to the supply port 53 by the spiral auger 52 in the casing 51. At this time, the flap 54 opens the supply port 53 again, and thus the new developer 44 is supplemented into the developer main body 40 through the supply port 53.

Next, the construction of the developer cartridge 50 will be described with reference to a perspective view of FIG. 4 and an exploded perspective view of FIG. 5.

The developer cartridge has a developer stock unit in which at least toner is stocked, and a developer withdrawing box mounted at one end of the developer stock unit. The detection unit is disposed so as to confront the developer withdrawing box, and it serves to detect the presence or absence of the developer withdrawn in the developer withdrawing box to identify whether the developer cartridge is new or old.

Figure 4:
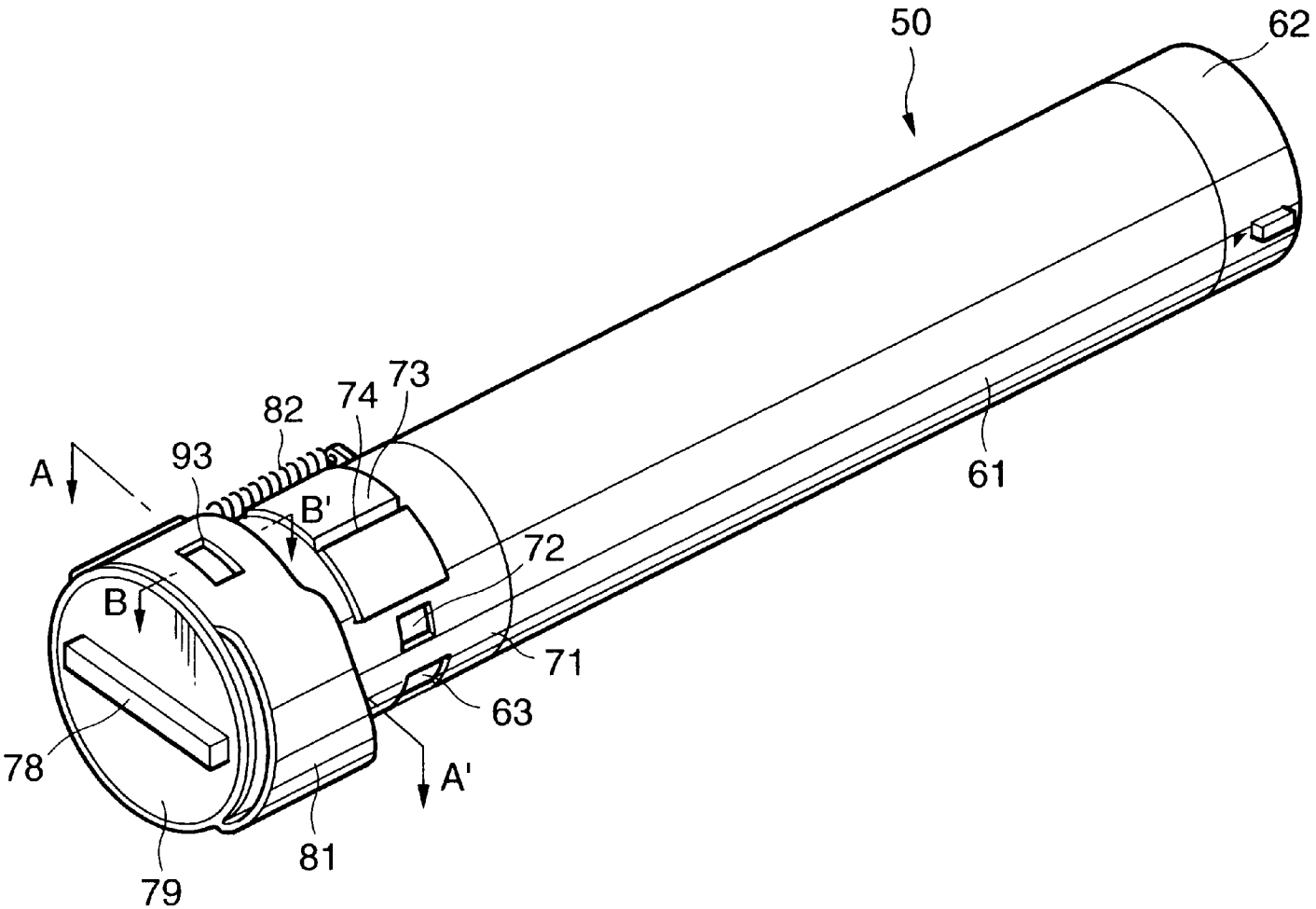
FIG. 4 is a perspective view showing the outlook of the developer cartridge of the first embodiment.
Figure 5:
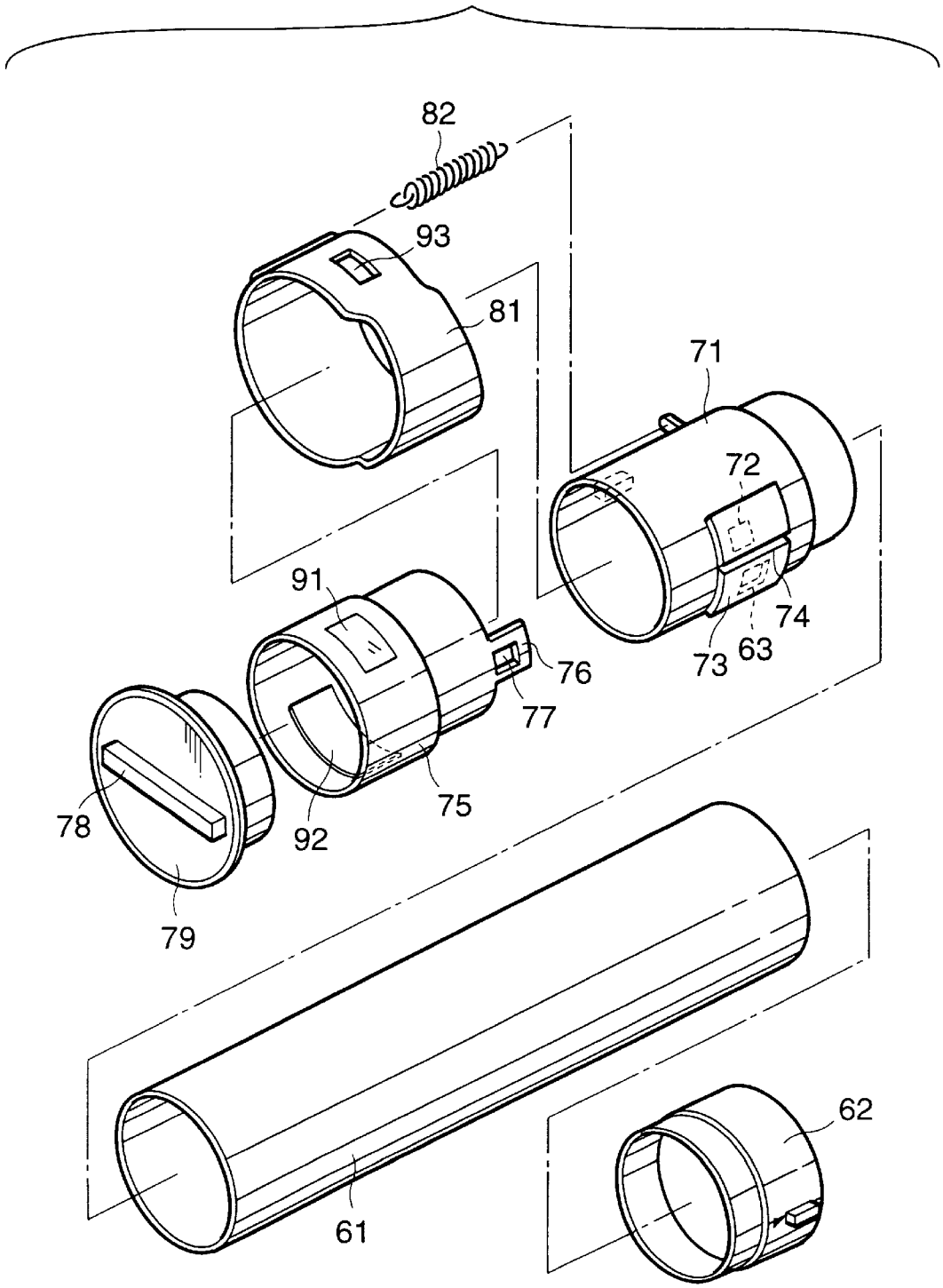
FIG. 5 is an exploded perspective view showing the developer cartridge of the first embodiment.

That is, as shown in FIGS. 4 and 5, the developer cartridge 50 has a stock case 61 as an elongated cylindrical developer stock unit (cylindrical member) for stocking new developer, a cap 62 as a cap member which is detachably mounted on the stock case 61 to close one end of the stock case 61, a supply port 63 as an inlet port for a passage through which the new developer is supplied from the stock case 61 to the developer main body 40 of the developing apparatus, a take-in port for taking in the deteriorated developer withdrawn from the developer, a cylindrical short withdrawing case 71 for stocking the deteriorated developer withdrawn through the take-in port 72, and a withdrawing box 75 as a developer withdrawing box fitted into the withdrawing case 71. As shown in FIG. 5, a tag piece 76 is formed on the withdrawing box 75, and an opening 77 formed in the tag piece 76 intercommunicates with the take-in port 72 when the withdrawing box is fitted into the withdrawing case 71. Further, a cap 79 having a handle 78 is press-fitted into the withdrawing box 75.

A recess portion is formed along the peripheral direction on the periphery of the supply port 63 and the take-in port 72 to form a guide groove. A shutter 73 which is bent in an arcuate form along the outer surface of the developer cartridge 50 is attached to the guide groove so as to be slidable in the peripheral direction. Further, a cylindrical slide cover 81 is slidably mounted so as to surround parts of the withdrawing box 75 and the withdrawing case 71. The slide cover 81 is urged by a spring 82 so as to cover the shutter 73 as shown in FIG. 5.

Therefore, when the developer cartridge 50 is not mounted on the developer cartridge mount portion of the rotor 30, the shutter 73 closes the supply port 63 and the take-in port 72 by the elastic force of an urging unit (not shown), and further the slider cover 81 covers the shutter 73.

On the other hand, when the developer cartridge 50 is inserted into the developer cartridge mount portion of the rotor 30, a long groove 74 formed in the width direction of the shutter 73 is engaged with a projection formed on the developer cartridge mount portion and the handle 78 is nipped and rotated by fingers, the developer cartridge 50 is rotated to move the shutter 73, so that the supply port 63 and the take-in port 72 are opened together. The slant open end of the slide cover 81 abuts against a stopper (not shown) at the apparatus side to expose the shutter 73. FIG. 4 shows such a state that the developer cartridge 50 is mounted on the developer cartridge mount portion, and it is shown in FIG. 4 that the supply port 63 and the take-in port 72 are opened.

In FIG. 5, reference numeral 91 represents a transparent window for detecting the old developer, reference numeral 92 represents a white sheet for detecting the old developer, and reference numeral 93 represents an opening portion for detecting the old developer.

In this embodiment, in the developer cartridge which is equipped with a cylindrical member for stocking developer containing at least toner, a supply port opened at one end side of the cylindrical member, and a spiral feeding member which is freely rotatably disposed in the cylindrical member, and serves to feed the developer stocked in the cylindrical member to the supply port by rotating the feeding member, the feeding member is mounted in the cylindrical member after the developer is filled in the cylindrical member.

In this embodiment, one end portion of the feeding member is freely rotatably attached to a cap member for sealing a developer filling open end portion of the cylindrical member, and the feeding member is mounted into the cylindrical member under the state that the cap member is attached to the feeding member.

Further, in this embodiment, when the feeding member is mounted in the cylindrical member, the feeding member is inserted into the cylindrical member filled with the developer while being rotated, and the rotational direction of the feeding member is set to the same section as the winding direction of the spiral of the feeding member.

Figure 1A:
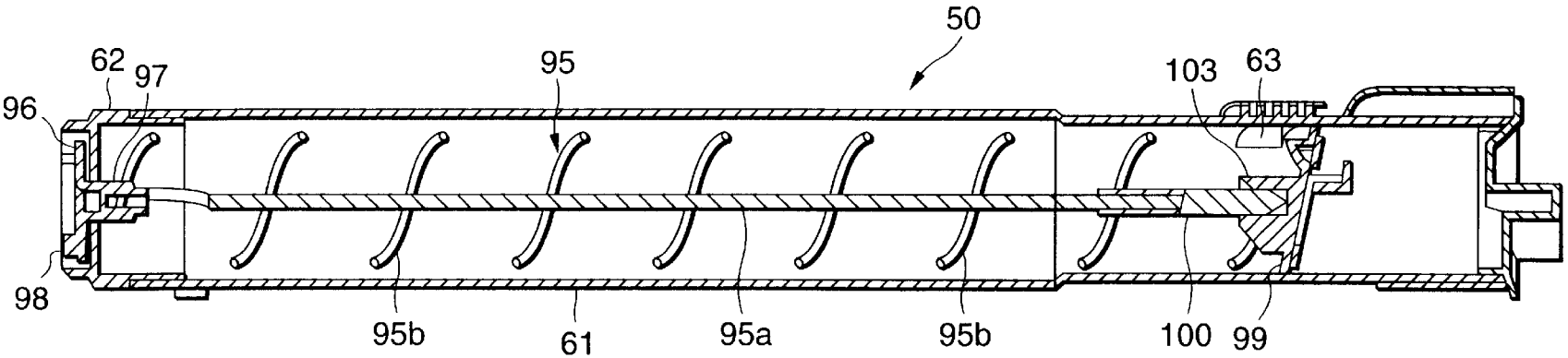
Figure 1B:
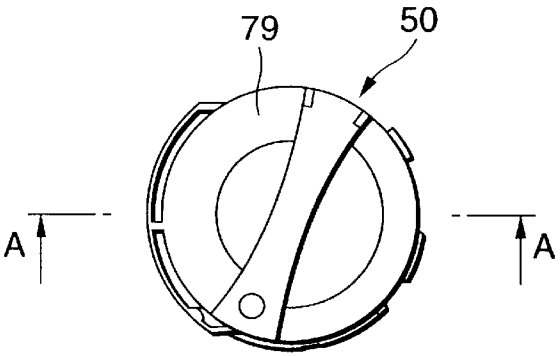

That is, as shown in FIGS. 1A, 1B and 4, the developer cartridge 50 to this embodiment has a stock case 61 serving as the cylindrical elongated developer stock unit (cylindrical member) for stocking new developer 44 obtained by mixing toner and carriers in a predetermined mixing ratio, a cap 62 serving as the cap member which is detachably on the stock case 61 so as to close one end of the stock case 61, a supply port 63 serving as the inlet port for a passage through which new developer 44 is supplied from the stock case 61 to the developer main body 40 of the developing apparatus, a take-in port 72 for taking in deteriorated developer C withdrawn from the developer main body 40, a cylindrical short withdrawing case 71 for stocking the deteriorated developer C withdrawn through the take-in port 72, and a withdrawing box 75 serving as the developer withdrawing box which is fitted into the withdrawing case 71. In FIG. 5, the stock case 61, the withdrawing case 71 and the withdrawing box 75 are constructed separated from each other, however, these members may be integrally constructed.

A spiral agitator 95 as the spiral feeding member is freely rotatably disposed in the stock case 61, and the developer 44 stocked in the stock case 61 is fed to the supply port 63 by rotating the spiral agitator 95. The base end portion of the spiral agitator 95 is fixedly fitted to the shaft portion 97 of a rotating member 96 which is freely rotatably attached to the cap 62 as shown in FIG. 1. Plural pawl portions 98 which are to be engaged with a driving member (not shown) at the developer main body 40 are provided on the outside end surface of the rotating member 96.

The spiral agitator 95 is formed of a wire rod of stainless, iron or the like, and it has a linear portion 95*a* extending in the axial direction at the center of the stock case 61, and spiral portions 95*b* which are spirally provided at the outer periphery of the linear portion 95*a*.

In this embodiment, the feeding member is pivotally supported at the end portion thereof opposite to the cap member in the cylindrical member through a shaft member and a bearing member.

In this embodiment, the shaft member is fixed to the end portion of the feeding member, the tip portion of the shaft member is tapered and the point angle of the tip portion of the shaft member is set to be more acute than 90 degrees.

Further, in this embodiment, the tip portion of the shaft member is provided with a developer discharging portion for discharging developer trapped in the bearing member when the shaft member is fitted into the bearing member.

Still further, in this embodiment, the shaft member is fixed to the tip of the feeding member, and the fixing force of the shaft member is set to such a level that the shaft member does not fall off the feeding member even when the shaft member is not fitted to the bearing member at the cylindrical member side and thus the feeding member is deformed.

Figure 6:
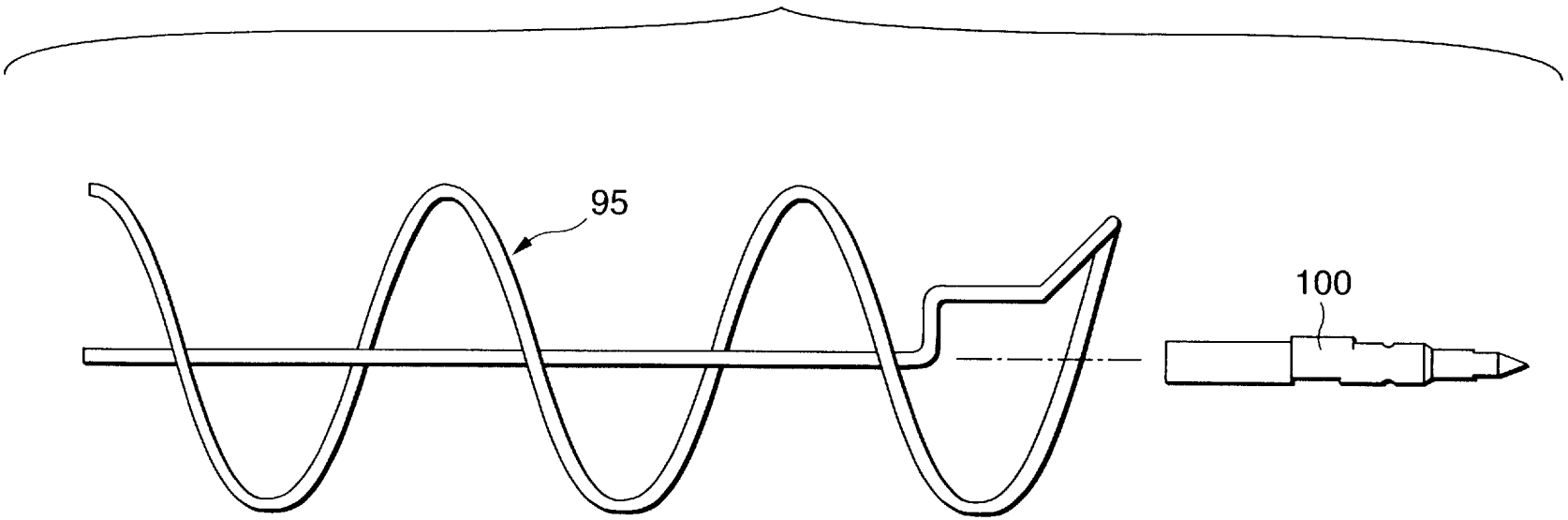
FIG. 6 is a front view showing the tip portion of a spiral agitator.
Figure 7:
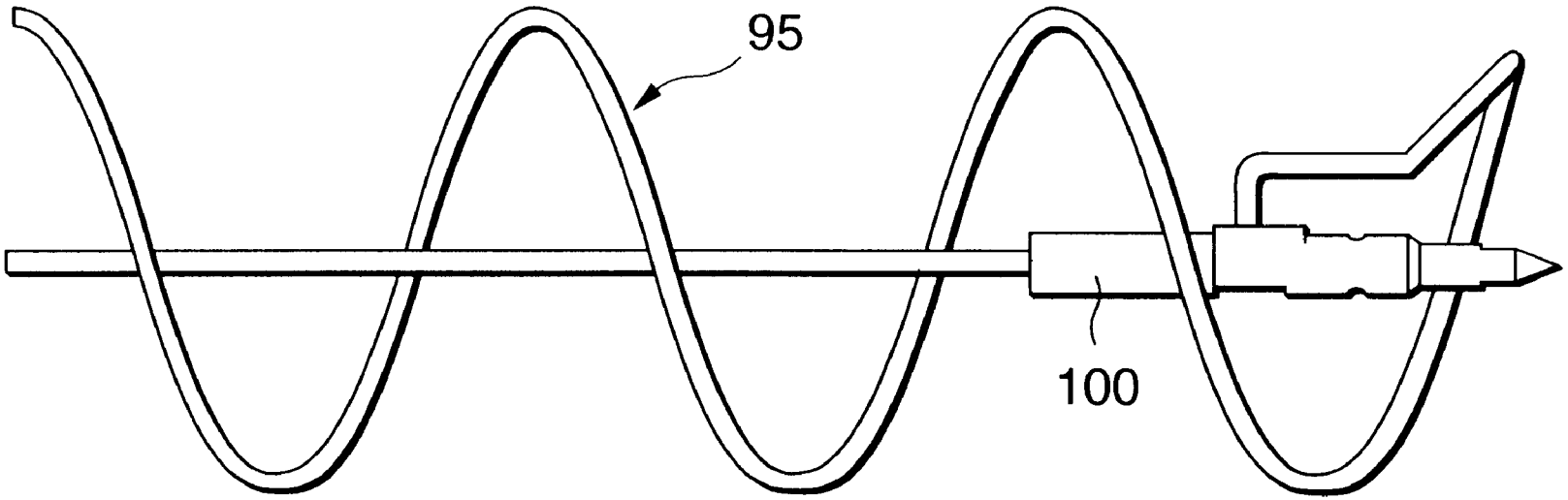
FIG. 7 is a front view showing the tip portion of the spiral agitator.

That is, the spiral agitator 95 is designed as a so-called double-side supported type, and it is freely rotatably attached to the cap 62 at the base end portion thereof. In addition, the tip portion thereof is freely rotatably pivotally supported on a partition wall 99 which is obliquely provided at the end portion of the back side in the stock case 61. Therefore, the shaft member 100 is firmly fixedly fitted to the tip portion of the spiral agitator 95 as shown in FIGS. 6 and 7. As shown in FIG. 8, the shaft member 100 is formed of synthetic resin of POM or the like, and a recess groove 101 is provided along the longitudinal direction at the base end portion side in the longitudinal direction thereof so as to be snap-fitted to the tip portion of the linear portion 95a of the spiral agitator 95. The sectional and planar shapes of the recess groove 101 are designed to be slightly broadened like a taper shape at the inlet side thereof and to be circular with the upper portion being opened at the back (deep) side thereof so as to snap-fit the tip portion of the linear portion 95*a* of the spiral agitator 95. The recess groove 101 is designed so that the tip portion of the linear portion 95*a* of the spiral agitator 95 can be firmly snap-fitted over the overall length in the longitudinal direction of the recess groove 101, and the fixing force of the shaft member 100 is set to such a level that the shaft member 100 does not fall off the agitator 95 even when the shaft member 100 is not fitted to the bearing member at the stock case 61 described later and the agitator 95 is deformed. The shaft member 100 may be formed integrally with the tip portion of the agitator 95 by an outsert molding.

Figure 8A:
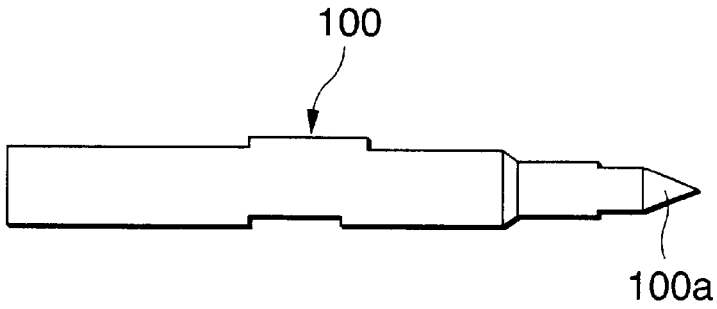
FIGS. 8A to 8C are front view, plan view and side view showing a shaft member which is attached to the spiral agitator.
Figure 8B:
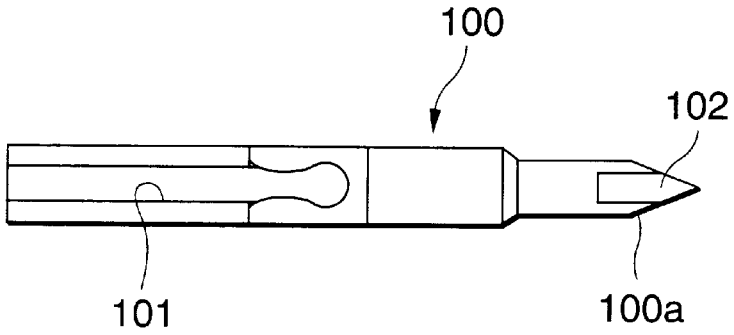
Figure 8C:
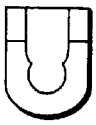

As shown in FIGS. 8A and 8B, the tip portion 100*a* of the shaft member 100 is designed to be tapered, and the point angle of the tip portion 100*a* of the shaft member 100 is set to be more acute (for example, 60 degrees) then 90 degrees.

Figure 9:
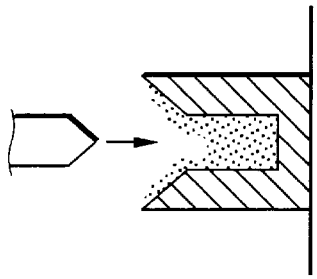
FIG. 9 is a diagram showing an experiment condition and a graph showing experiment results.
Figure 9:
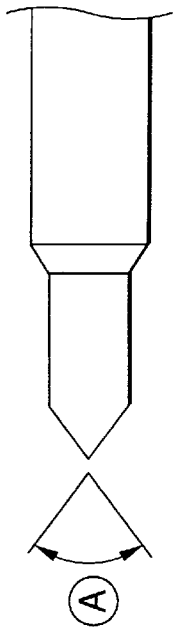

The inventors of this application have tested to check whether the shaft member 100 can be inserted into the bearing member in which toner exists while varying the point angle of the tip portion 100*a* of the shaft member 100 as shown in FIG. 9. As a result, it is apparent from FIG. 9 that if the point angle of the tip portion of the shaft member is more acute than 90 degrees, the shaft member can be excellently inserted into the bearing member in which the toner exists. Replace Further, the shaft member 100 is provided, at both the surfaces of the tip portion 100*a* thereof, with a recess groove 102 as the developer discharging portion for discharging the developer trapped in the bearing member when the shaft member 100 is fitted to the bearing member.

In this embodiment, a guide portion for guiding the shaft member into the bearing member is provided to the tip portion of the bearing member.

Further, in this embodiment, the bearing member is provided with the developer discharging portion for discharging the developer trapped in the bearing member when the shaft member is fitted into the bearing member, and the developer discharging portion provided to the bearing member is constructed by plural opening portions which are provided along the axial direction on the inner surface of the bearing member. The opening portions are not opened to the radial direction of the bearing member.

Figure 10:
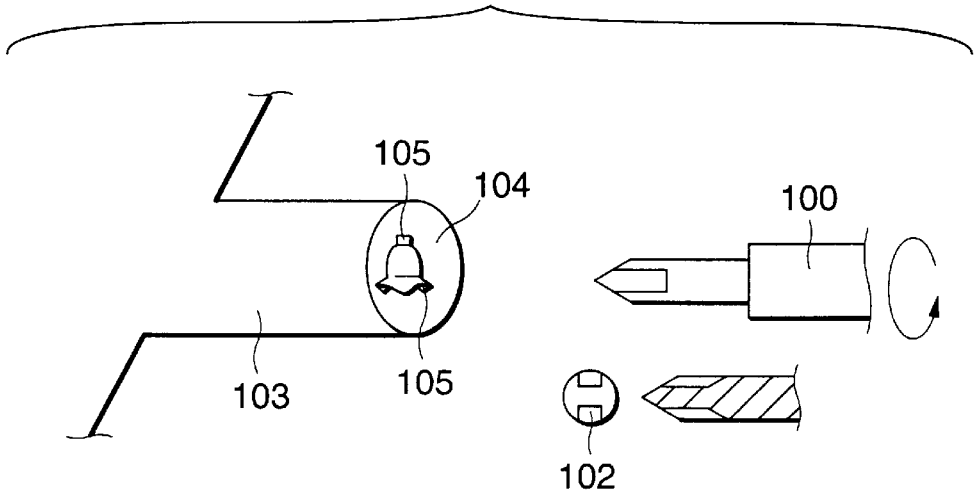
FIG. 10 is a diagram showing a shaft member and a bearing member attached to the tip portion of a spiral auger.
Figure 11:
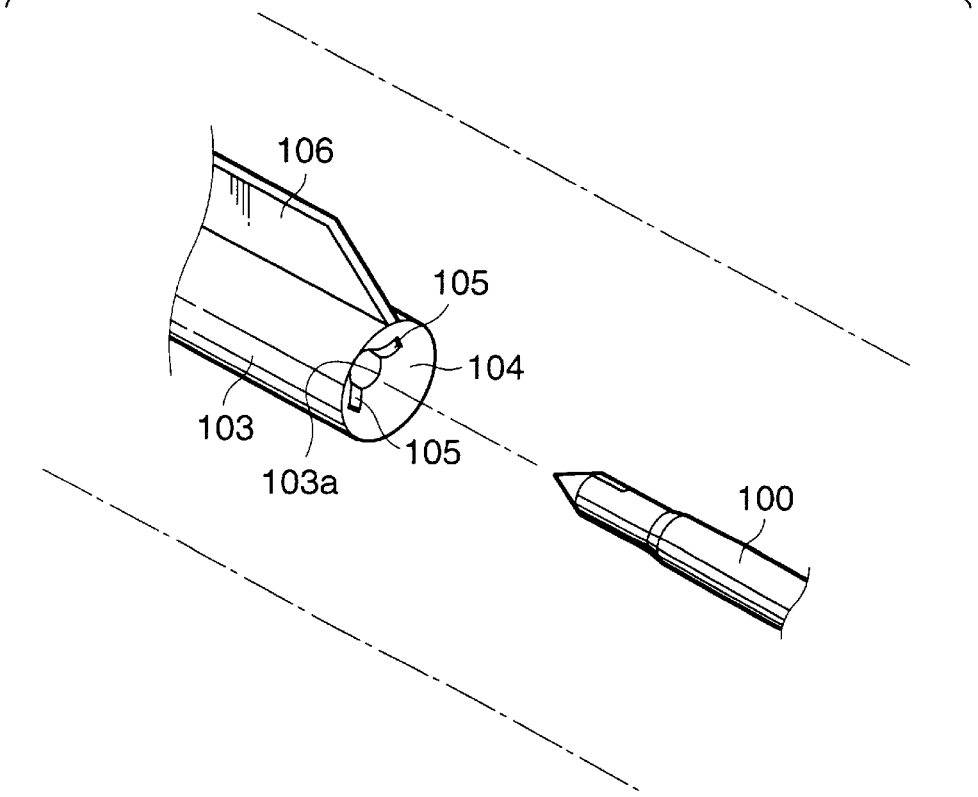
FIG. 11 is a perspective view showing the shaft member and the bearing member attached to the tip portion of the spiral auger.

As shown in FIGS. 1, 10 and 11, a bearing member 103 which supports the shaft member 100 of the spiral agitator 95 while they are engaged with each other and freely rotatably supports the tip portion of the spiral agitator 95 is provided to the partition wall at the back side in the stock case 61. As shown in FIGS. 10 and 11, the tip portion of the bearing member 103 is provided with a taper portion 104 serving as the guide portion for guiding the shaft member 100 into the bearing member 103.

The bearing member 103 is provided with a developer discharging portion 105 for discharging the developer 44 trapped in the bearing member 103 when the shaft member 100 is fitted into the bearing member 103. The developer discharging portion 105 provided to the bearing member 103 is constructed by plural (in this embodiment, three) opening portions having a recess-groove shape which are provided along the axial direction on the inner surface 103*a* of the bearing member 103. The opening portions 105 are not opened to the radial direction of the bearing member 103, thereby preventing the toner from invading from the outside into the bearing member 103.

In this embodiment, the feeding member is supported at both the end portions by the shaft, and it is designed so that it is not brought into contact with the inner wall of the cylindrical member even when it is most warped. At this time, the center portion in the axial direction of the feeding member is formed to be smaller in diameter than both the end portions of the feeding member.

Figure 12:
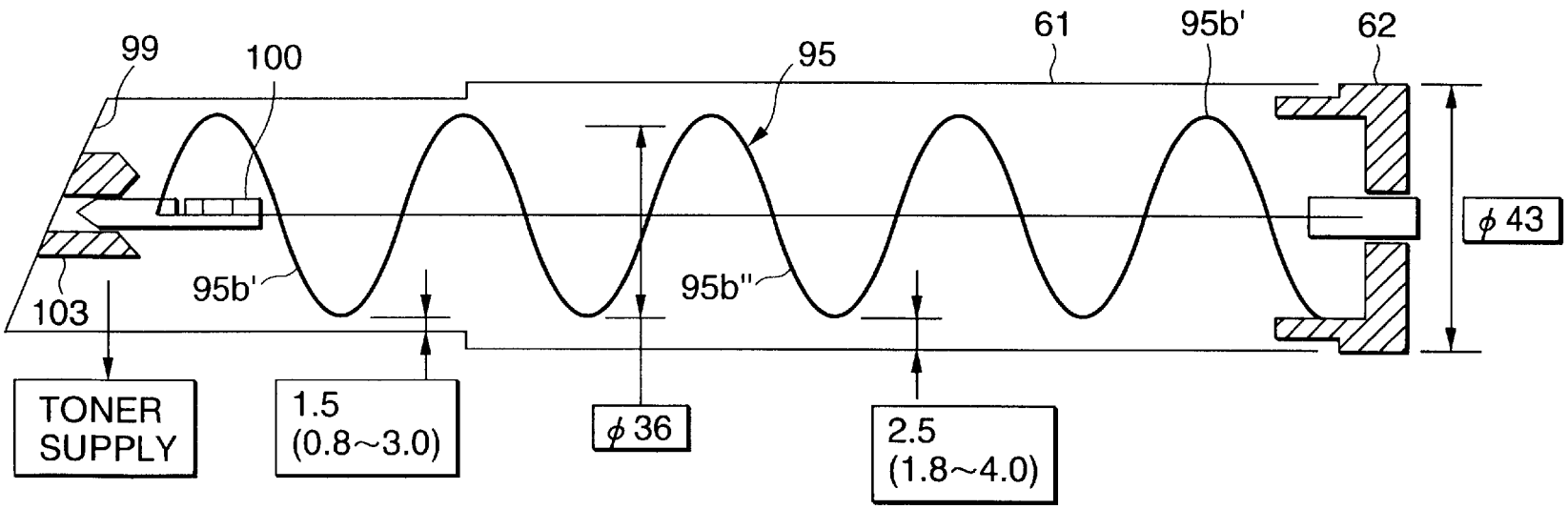
FIG. 12 is a longitudinally sectional view showing the construction of the developer cartridge and the spiral auger.

That is, as described above, as shown in FIG. 1, the spiral agitator 95 is formed of the wire rod of stainless, iron or the like, and it is constructed by the linear portion 95*a* extending in the axial direction at the center of the stock case 61, and the spiral portion 95*b* which are spirally provided at about seven to eight turns on the outer periphery of the linear portion 95*a*. The spiral portion 95*b* of the spiral agitator 95 is formed in the spiral shape having a predetermined outer diameter and a predetermined pitch. As shown in FIG. 12, the spiral portion 95*b* of the spiral agitator 95 is designed so that the outer diameter of the 1.5 turn portion of each of both the end portions 95*b*' is relatively large (for example, the outer diameter is set to 38 mm) and that of the center portion 95*b*" excluding both the end portions is relatively small (for example, the outer diameter is set to 36 mm). In FIG. 12, it is illustrated that the outer diameter of the back side (the left side in FIG. 12) of the stock case 61 seems to be smaller, however, this is not relevant to the subject matter of the present invention.

As described above, the spiral portion 95*b* of the spiral agitator 95 is designed so that the center portion 95*b*" thereof is set to be relatively small in outer diameter. The degree of reducing the outer diameter of the center portion 95*b*" is set so that the center portion of the agitator is not brought into contact with the inner wall of the developer cartridge 50 even when the spiral agitator 95 is warped even in consideration of the factors such as its own weight, the press force of the developer, or the centrifugal force at the rotation time or the acceleration at the stop time of the rotation in the case of the rotary type developing apparatus 5. In this case, the probability that the center portion of the agitator is brought into contact with the inner wall of the developer cartridge 50 can be reduced more as the outer diameter of the center portion 95*b*" of the spiral agitator 95 is smaller. However, as the outer diameter of the agitator is reduced, the feeding performance of the developer by the spiral agitator 95 is reduced, and finally the amount of the developer trapped in the developer cartridge is increased. Therefore, the outer diameter of the center portion 95*b*" of the spiral agitator 95 is preferably set to the maximum value in such a range that the center portion 95*b*" of the spiral agitator 95 is not brought into contact with the inner wall of the developer cartridge 50 even when the spiral agitator 95 is warped even in consideration of factors such as its own weight, the press force of the developer, or the centrifugal force at the rotation time or the acceleration at the stop time of the rotation in the case of the rotary type developing apparatus 5.

In this embodiment, the shaft member is fixed to the tip of the feeding member, and there is provided a rotation stop member for stopping the rotation of the feeding member when the shaft member is not fitted into the bearing member at the cylindrical member side.

That is, as shown in FIGS. 1 and 11, the bearing member 103 for pivotally supporting the tip portion of the spiral agitator 95 so that the spiral agitator is freely rotatable is provided on the partition wall 99 at the back side in the stock case 61, and a flange portion 106 serving as the rotation stop member for stopping the rotation of the spiral agitator 95 when the shaft member 100 provided to the tip portion of the spiral agitator 95 is not fitted to the bearing member 103 is projectively provided on the outer periphery of the bearing member 103 as shown in FIG. 11. That is, when the tip portion of the spiral agitator 95 is not fitted into the bearing member 103, the tip portion of the spiral agitator 95 abuts against the outer peripheral surface of the bearing member 103 due to its own elastic force and is rotated. At this time, the tip portion of the spiral agitator 95 abuts against the flange portion 106 of the bearing member 103, and thus the spiral agitator 95 cannot be further rotated.

According to the developer cartridge according to this embodiment thus constructed, the developer containing at least toner can be efficiently filled into the developer cartridge as follows.

Further, in this embodiment, even when the feeding member is mounted in the developer cartridge after the developer containing at least the toner is filled into the developer cartridge, the mount work of the cap member can be easily performed.

Still further, in this embodiment, even when the toner particles are designed in small size or toner containing wax is used, the feeding member and the inner wall of the developer cartridge can be surely prevented from being rubbed against each other, thereby preventing occurrence of image quality deterioration due to agglomerated toner.

In this embodiment, the driving apparatus for rotating the feeding member can be avoided from being designed in large size.

In this embodiment, even when the so-called double-side supported type feeding member is used, the feeding member and the inner wall of the developer cartridge can be surely prevented from interfering in each other.

In this embodiment, even when the so-called double-side supported type feeding member is used, the tip of the feeding member can be surely pivotally supported.

In addition, in this embodiment, even when the so-called double-side supported type feeding member is used, agglomerated toner can be surely prevented from being newly generated at the portion where the feeding member is pivotally supported.

Further, in this embodiment, even when the so-called double-side supported type feeding member is used, it can be easily checked whether the feeding member is normally pivotally supported.

Figure 13:
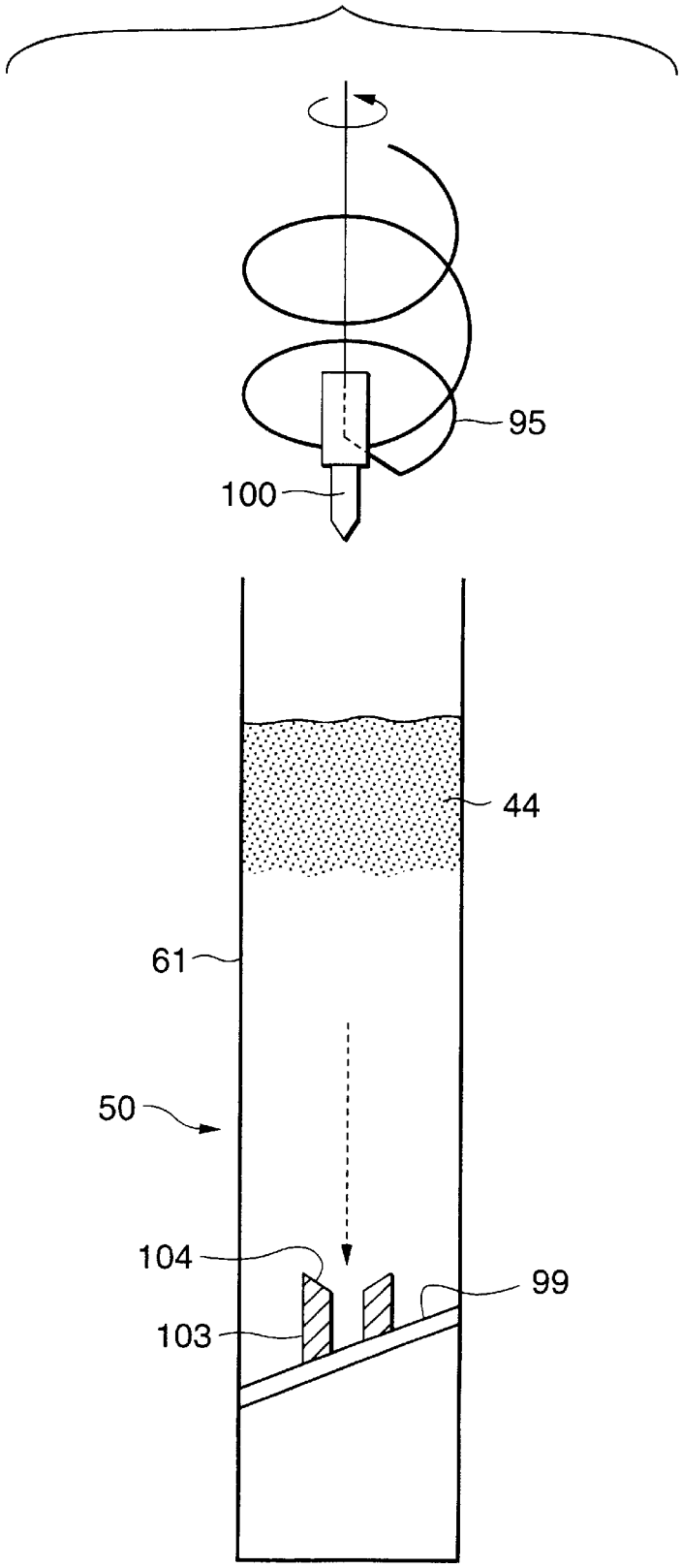
FIG. 13 is a diagram showing the state that the spiral auger is mounted after developer is filled in the developer cartridge.

That is, in the developer cartridge 50 according to this embodiment, after the developer 44 is filled into the stock case 61 of the developer cartridge 50, as shown in FIG. 13, the cap 62 to which the spiral agitator 95 is attached is mounted in the stock case 61 having the developer 44 filled therein while the spiral agitator 95 is rotated by a driving unit (not shown). At this time, the rotational direction of the spiral agitator 95 is set to the same direction as the spiral direction of the spiral agitator 95 concerned.

As described above, the spiral agitator 95 is mounted in the stock case 61 of the developer cartridge 50 after the developer 44 is filled in the stock case 61 of the developing cartridge 50, so that the developer 44 containing at least the toner can be efficiently filled into the developer cartridge 50.

In this embodiment, the spiral agitator 95 is mounted into the stock case 61 filled with the developer 44 while being rotated. Therefore, the spiral agitator 95 advances forwardly while screwed into the developer 44 by the screw portion thereof, and the shaft member 100 attached to the tip portion of the spiral agitator 95 is fitted into the bearing member 103 provided to the stock case 61 as shown in FIG. 1. Further, since the spiral agitator 95 is freely rotatably attached to the cap 62, the mount work of the cap 62 can be easily performed even when the agitator 95 is mounted into the developer cartridge 50 after the developer 44 containing at least the toner is filled in the developer cartridge 50.

In the developer cartridge 50, the spiral agitator 95 is supported at both the ends thereof by the cap 62 and the partition wall 99 of the stock case 61, that is, the spiral agitator 95 is designed as the so-called double-side supported type. Accordingly, the spiral agitator 95 is basically different from the so-called one-side supported type agitator, and it is hardly brought contact with the inner wall of the stock case 61, so that the driving device for rotating the spiral agitator 95 is not required to be designed in large size.

Figure 14:
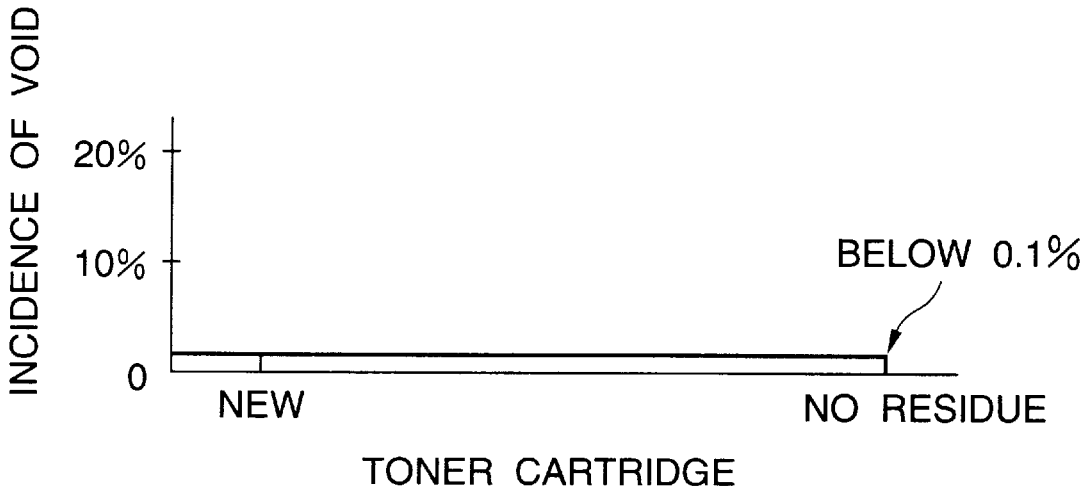
FIG. 14 is a graph showing experiment results.
Figure 15:
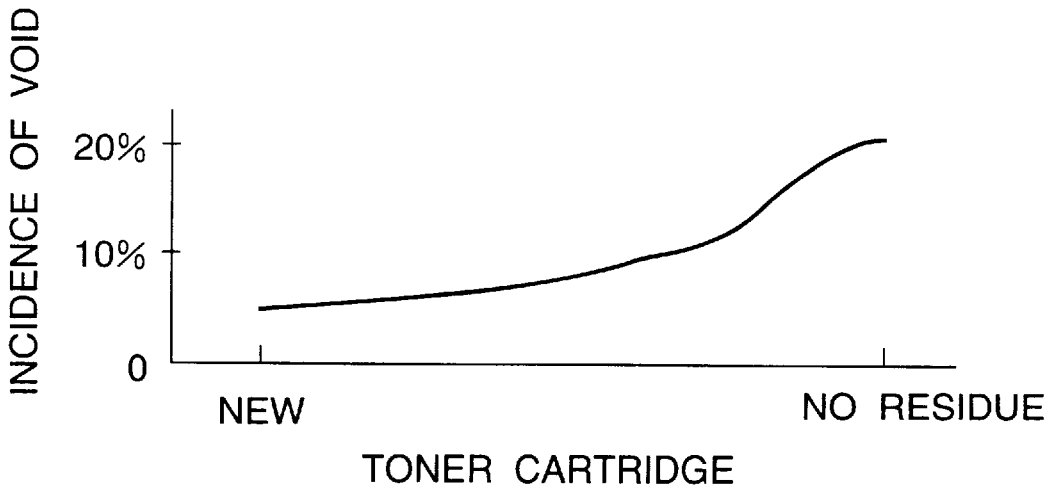
FIG. 15 is a graph showing experiment results.

In addition, in this embodiment, the outer diameter of the center portion 95*b*" of the spiral agitator 95 is set to a relatively small value, and thus it can be surely prevented from coming into contact with the inner wall of the stock case 61. Further, even when the toner particle diameter is reduced or toner containing wax is used, the occurrence of image quality deterioration due to agglomerated toner can be substantially perfectly prevented as shown in FIGS. 14 and 15.

Further, in this embodiment, the recess groove 102 as the developer discharging portion is provided to the shaft member 100 attached to the tip portion of the spiral agitator 95, and also the opening portion 105 as the developer discharging portion is provided to the bearing member 103. Therefore, the developer 44 is hardly trapped in the bearing member 103, and thus the shaft member 100 of the spiral agitator 95 can be surely fitted into the bearing member 103. Even when the so-called double-side supported type agitator 95 is used, agglomerated toner can be surely prevented from be newly generated at the portion at which the agitator 95 is pivotally supported.

In this embodiment, the guide portion 104 is provided to the tip portion of the bearing member 103, so that the shaft member 100 of the spiral agitator 95 can be more surely fitted into the bearing member 103.

Further, in this embodiment, the flange portion 106 as the rotation stop member for stopping the rotation of the spiral agitator 95 when the shaft member provided to the tip portion of the spiral agitator 95 is not fitted into the bearing member 103 is provided on the outer periphery of the bearing member 103 as shown in FIG. 11. Therefore, when the shaft member 100 provided to the tip portion of the spiral agitator 95 is not fitted into the bearing member 103, the spiral agitator 95 is prevented from being rotated. Accordingly, even when the torque of the electric motor for rotating the spiral agitator 95 is sharply increased and the so-called double-side supported type agitator is used, it can be easily checked whether the agitator is normally pivotally supported.

In this embodiment, the shaft member is provided to the feeding member side, and the bearing member is provided to the cartridge side. However, the present invention is not limited to this embodiment, and it may be modified so that the bearing member is provided to the feeding member side and the shaft member is provided to the cartridge side. In such a case, the bearing member is fixed to the tip of the feeding member and a through hole is formed inside the bearing member, so that the developer in the cartridge can be discharged through the through hole inside the bearing member when the shaft member is fitted into the bearing member of the feeding member. Therefore, there can be achieved a remarkable effect that the developer can be easily discharged.

As described above, according to the developer cartridge of the present invention, the developer containing at least toner can be efficiently filled.

According to the developer cartridge of present invention, even when the developer cartridge is designed so that the feeding member is mounted into the developer cartridge after the developer containing at least the toner is filled into the developer cartridge, the mount work of the cap member can be easily performed.

According to the developer cartridge of the present invention, even when the toner particle size is reduced or toner containing wax is used, the feeding member and the inner wall of the developer cartridge can be surely prevented from being rubbed against each other, and the image quality deterioration due to the agglomerated toner can be prevented.

According to the developer cartridge of the present invention, the driving device for rotating the feeding member can be prevented from being designed in large size.

According to the developer cartridge of the present invention, even when the so-called double-side supported type feeding member is used, the feeding member and the inner wall of the developer cartridge can be surely prevented from interfering in each other.

According to the developer cartridge of the present invention, even when the so-called double-side supported type feeding member is used, the tip of the feeding member can be surely pivotally supported.

Accordingly to the developer cartridge of the present invention, even when the so-called double-side supported type feeding member is used, new agglomerated toner can be surely prevented from being generated at the portion at which the feeding member is pivotally supported.

According to the developer cartridge of the present invention, even when the so-called double-side supported type feeding member is used, it can be easily checked whether the feeding member can be normally pivotally supported.

What is claimed is:

1. A developer cartridge comprising:

a cylindrical member in which developer containing at least toner is stocked;

a supply port opened in the cylindrical member; and a spiral feeding member which is freely rotatably disposed in the cylindrical member, the feeding member being rotated to feed the developer stocked in the cylindrical member to the supply port, wherein the feeding member is mounted in the cylindrical member after the developer is filled in the cylindrical member.

2. The developer cartridge as claimed in claim 1, wherein one end portion of the feeding member is freely rotatably attached to a cap member for sealing an open end portion of the cylindrical member through which the developer is filled, and the feeding member is mounted in the cylindrical member while being attached to the cap member.

3. The developer cartridge as claimed in claim 1, wherein when the feeding member is mounted in the cylindrical member, the feeding member is inserted into the cylindrical member filled with the developer while being rotated.

4. The developer cartridge as claimed in claim 3, wherein the rotational direction of the feeding member is set to the same direction as the winding direction of the spiral of the feeding member.

5. A developer cartridge comprising:

a cylindrical member in which developer containing at least toner is stocked;

a supply port opened in the cylindrical member;

a spiral feeding member which is freely rotatably disposed in the cylindrical member, the feeding member being rotated to feed the developer stocked in the cylindrical member to the supply port; and a cap member for sealing an open end portion of the cylindrical member, wherein the feeding member is freely rotatably attached to the cap member at one end portion thereof, and pivotally supported in the cylindrical member through a shaft member and a bearing member, from which any developer trapped is automatically removed, at the other end portion opposite to the cap member.

6. The developer cartridge as claimed in claim 5, wherein the shaft member is fixed to the end portion of the feeding member, and a tip portion of the shaft member is tapered and has an acute angle less than 90 degrees.

7. The developer cartridge as claimed in claim 5, wherein the shaft member is fixed to the end portion of the feeding member, and a developer discharging portion for discharging the developer trapped in the bearing member when the shaft member is fitted into the bearing member is provided at a tip portion of the shaft member.

8. The developer cartridge as claimed in claim 5, wherein the bearing member is fixed in the cylindrical member and a guide portion for guiding the shaft member into the bearing member is provided to the tip portion of the bearing member.

9. The developer cartridge as claimed in claim 5, wherein the bearing member is fixed in the cylindrical member, and a developer discharging portion for discharging developer trapped in the bearing member is provided to the bearing member when the shaft member is fitted into the bearing member.

10. The developer cartridge as claimed in claim 9, wherein the developer discharging portion provided to the bearing member comprises plural opening portions formed along the axial direction on the inner surface of the bearing member.

11. The developer cartridge as claimed in claim 10, wherein the opening portions are not opened in the radial direction of the bearing member.

12. The developer cartridge as claimed in claim 5, wherein the feeding member is supported at both the end portions thereof by a shaft, and is not brought into contact with the inner wall of the cylindrical member when it is most bent.

13. The developer cartridge as claimed in claim 12, wherein a center portion of the feeding member in the axial direction is set to be smaller in diameter than both the end portions thereof.

14. The developer cartridge as claimed in claim 12, wherein the feeding member comprises a linear portion extending in the axial direction of the cylindrical member and a spiral portion which is provided spirally around the outer periphery of the linear portion, and the spiral portion is fixed to the linear portion at the center portion of the feeding member to prevent the spiral portion from being deformed.

15. The developer cartridge as claimed in claim 5, wherein the shaft member is fixed to the tip of the feeding member, and the fixing force of the shaft member is set to be within a range of a level in which the shaft member does not fall off the feeding member even when the shaft member is not fitted into the bearing member at the cylindrical member side and the feeding member is deformed.

16. The developer cartridge as claimed in claim 5, wherein the shaft member is fixed to the tip of the feeding member, and there is provided a rotation stopping member for stopping the rotation of the feeding member when the shaft member is not fitted into the bearing member at the cylindrical member side.

17. The developer cartridge as claimed in claim 16, wherein the bearing member is fixed to the tip of the feeding member and a through hole is formed inside the bearing member.

18. A method of manufacturing a developer cartridge comprising a cylindrical member in which developer containing at least toner is stocked, a supply port opened in the cylindrical member, and a spiral feeding member which is freely rotatably disposed in the cylindrical member, the feeding member being rotated to feed the developer stocked in the cylindrical member to the supply port, the method comprising the steps of:

filling the developer in the cylindrical member; and mounting the feeding member in the cylindrical member.

* * * * *